United States Patent [19]

Svyatsky

[11] Patent Number: 4,893,952

[45] Date of Patent: Jan. 16, 1990

[54] DOT MATRIX PRINTING SYSTEM INCLUDING IMPROVED INK TRANSFER MECHANISM

[75] Inventor: Eduard Svyatsky, Chicago, Ill.

[73] Assignee: Bell & Howell Company, Chicago, Ill.

[21] Appl. No.: 109,474

[22] Filed: Oct. 16, 1987

[51] Int. Cl.[4] ..... B41J 3/12; B41J 27/02

[52] U.S. Cl. ..... 400/470; 400/188; 400/662

[58] Field of Search ..... 400/124 IW, 470, 471, 400/471.1, 662, 188; 101/93.04, 93.05, 348

[56] References Cited

U.S. PATENT DOCUMENTS

| | | | |
|---|---|---|---|
| 1,938,371 | 12/1933 | Bottle | 400/662 |
| 3,260,193 | 7/1966 | Mann | 101/35 |
| 4,335,971 | 6/1982 | de Mey | 400/659 X |
| 4,458,399 | 7/1984 | Kessler | 400/470 |
| 4,522,672 | 6/1985 | Brister et al. | 101/288 X |

FOREIGN PATENT DOCUMENTS

| | | | |
|---|---|---|---|
| 729561 | 5/1955 | United Kingdom | 101/348 |

OTHER PUBLICATIONS

T. E. Schall and W. H. Swart, "Platen Inking Back Printer", IBM Technical Disclosure Bulletin, vol. 21, No. 9, (Feb. 1979), p. 3729.

T. E. Cassada and D. A. Kightlinger, "Electrochemical Printer", IBM Technical Disclosure Bulletin, vol. 24, No. 8, (Jan. 1982), p. 4332.

*Primary Examiner*—Paul T. Sewell

*Attorney, Agent, or Firm*—Laff, Whitesel, Conte & Saret

[57] ABSTRACT

This invention relates to an improved dot matrix-type printing system wherein the wires of the print head are arranged to impinge on the reverse side of the workpiece to cause it to be moved into contact with a cavitated ink transfer roller, whereby, the workpiece is brought into direct contact with ink droplets carried by the caves in the cavitated surface in such a fashion as to create a symbolic array on the frontside of the workpiece. Secondary embodiments utilize finely apertured belt means and a source of ink disposed inside of said belt with the workpiece being impinged into contact with the ink carrying belt means.

8 Claims, 3 Drawing Sheets

DOT MATRIX PRINTING SYSTEM INCLUDING IMPROVED INK TRANSFER MECHANISM

The present invention relates to a form of improved dot matrix printing system wherein the wires of the imprinting mechanism impinge on the backside of the workpiece and cause the workpiece to move into contact with an ink carrying transfer roller.

BACKGROUND OF THE INVENTION

In normal dot matrix printers, the wires are activated to strike an inked ribbon which is impressed against the document being printed and with the latter being backed-up by suitable means, such as a platen or plate means. The problems with such printers are well known in that the wires get dirty, create smudgy copy, and the ribbons dry out, fray and generally have to be replaced quite frequently in the normal course of business.

Another technique involves the use of a smooth ink carrying transfer roller whereby the wires of the dot matrix print mechanism impinge on the backside of the workpiece and push the document in a negative impression manner against the transfer roller to pick up or absorb an array of ink producing the correct symbolism on the frontside of the workpiece. Devices, such as the latter ones, have distinct problems in that the ink, through gravity, tends to go to the edge of the roller and drip off making an undesirable mess. Additionally such devices tend to produce spots and bubbles of ink which cause smudging of the copy.

In offset and gravure printing of ink fountain applicator roll is generally used. This roll has a cellular type surface. The roll rotates in an ink fountain so the cells in the surface will pick up ink. The surface is doctored to remove excess ink and then depending upon the type of printing, the ink is transferred to a printing roll or blanket or the like. The cells in the surface of the applicator roll are provided to give an accurate and metered amount of ink or other material which is to be applied.

Transfer, applicator, and metering rollers of varying material compositions can be found in the art, i.e., the U.S. Pat. Nos. to Broderick—3,924,313; Fadner et al.—4,537,127; and Jenkins et al.—4,566,938. These are representative of disclosures of transfer rollers which utilize engraved, etched or other forms of produced indentations for moving quantities of ink or other materials from one location to another.

SUMMARY OF THE PRESENT INVENTION

The present invention relates to an improved form of dot matrix printer mechanism where the wires of the printer mechanism impinge on the backside of the workpiece and cause it to move into contact with an ink transfer roller. The ink transfer roller contemplated by the present invention includes a composite transfer roller having a substantial portion thereof cavitated to improve its holding power in a uniform fashion of the ink droplets substantially uniformly covering said portion. When the pins push the workpiece against the transfer roller, the workpiece absorbs the ink held in the cavities of the cavitated portion.

It is an object of the present invention to provide a substantially rigid cavitated roller capable of maintaining a quantity of ink-like material in a widely disbursed manner with adequate surface tension between the ink material and the roller to substantially prevent dripping or bubbling.

Another object of the present invention is to provide a metallic transfer roller which has a substantial portion of its circumferential surface sandblasted to give a random but completely cavitated surface of a predetermined depth.

A further object of the present invention is to provide a printing system wherein a strip-like workpiece can be moved in a controlled manner past a cavitated ink carrying surface and supported, in predetermined spaced relation by suitable means, in front of said surface; a dot matrix type wire print head is positioned in spaced opposition to said surface and adapted to impinge on said workpiece and move it at least said predetermined distance into the plane of and contact with the ink droplets projecting slightly out of the pockets of said cavitated surface to form a symbolism array on the surface of the workpiece.

A further object of the present invention is to provide a hardened steel roller that is sandblasted to form a controlled cavitation on its surface and with said roller coaxially associated with at least one smooth roller of slightly greater diameter than said sandblasted roller to thereby permit a workpiece to be maintained in spaced relation thereto.

Still another object of the present invention is to provide a system of printing wherein an impregnated ink roller is in contact with the ink transferring roller at a position remote from the wire impinging printer mechanism.

Other objects will become apparent to those skilled in the art when the claims are read in conjunction with the detailed specification and the attached drawing wherein:

DETAILED DESCRIPTION OF THE INVENTION

Figure 1:
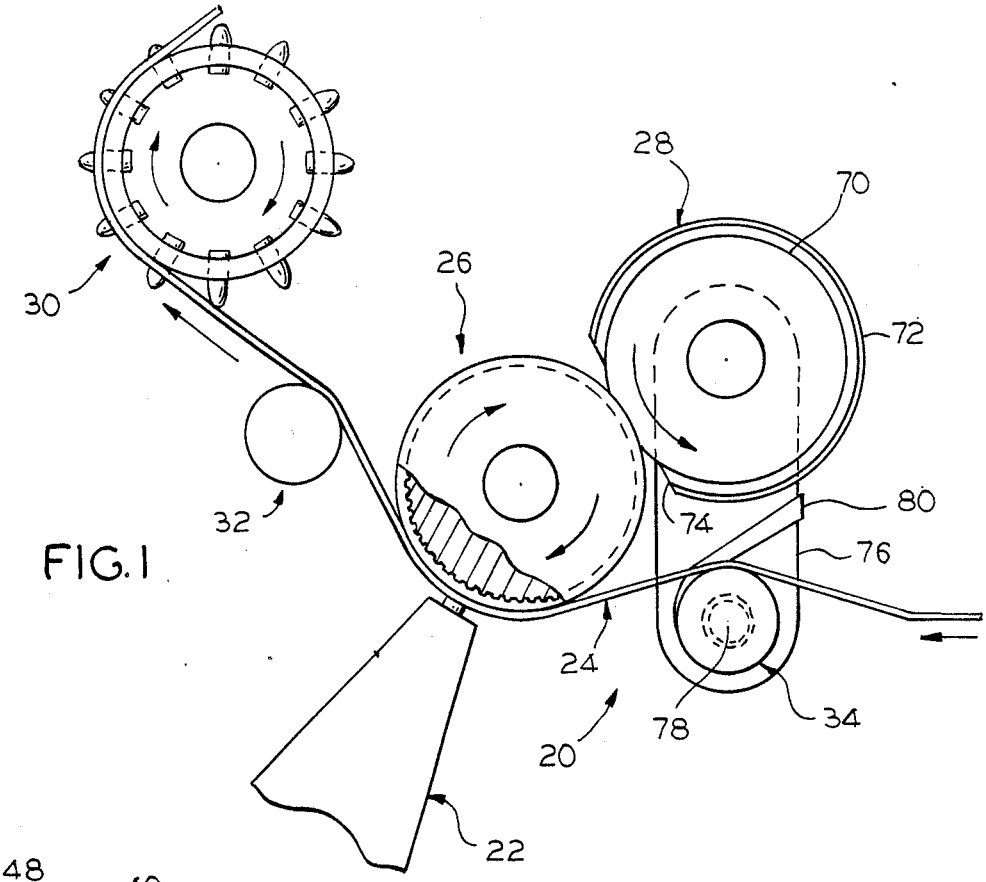
FIG. 1 is a plan view in partial section of a printing system of the type contemplated by the present invention.

Referring now to the drawing wherein similar parts are designated by similar numerals, a system 20, of the type contemplated, utilizes the concept of providing a dot matrix type wire printer 22 that is directed by a suitable known signal generating computer means, not shown, to impinge on the backside of a workpiece 24 to move the workpiece in a predetermined manner into proximity with a novel ink transfer roller assembly 26. The system also includes an ink supplying means 28, which in the present embodiment is an impregnated ink roller, as well as a drive means 30 for movement of the workpiece, and means such as idler rollers 32 and 34 for maintaining tension and contact of the workpiece with the transfer roller assembly 26. While the present embodiment shows a continuous strip or web of material to be printed upon, it is recognized that the present invention could be adapted to utilize well known sheet feed mechanisms or manual feeding in place of the continuous web arrangement shown.

In the prior art, there have been arrangements for printing from the reverse side of the workpiece, however, as was pointed out above, these attempts involved the use of smooth rollers in which the ink sagged or dripped off of the end of the roller and caused ruined workpieces due to smudging and poor impressions due to the lack of uniformity of ink distribution caused by bad dispersion of the ink as a result of its mobility due to gravity and other factors. The present invention contemplates the use of a cavitated roller as the transfer roller with which the workpiece will come into direct contact.

As was indicated above the prior art has made some limited usage of etched, engraved, or pitted surfaces on rollers that served as the intermediate roller that transferred ink from the ink fountain to a printing roll or blanket or the like. It is new and novel to make use of a cavitated roller as the principal printing roller with which the workpiece comes into intimate contact.

Figure 2:
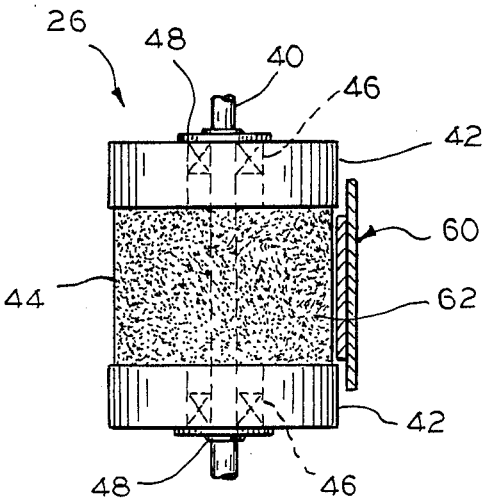
FIG. 2 is an elevational view of the type of ink transfer roller contemplated by the present invention.
Figure 3:
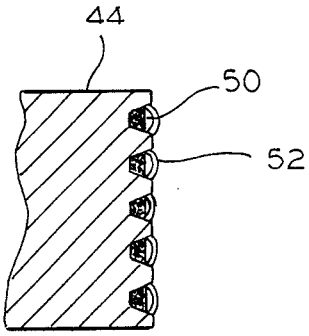
FIG. 3 is an enlarged partial elevational view in section of such a transfer roller.

As can be best seen in FIG. 2, the roller assembly 26 includes a shaft 40 on which is mounted at least one smooth roller 42 at an end of the central cavitated roller 44. In the present embodiment a smooth roller 42 is disposed at each of the opposite ends of central roller 44. Each of the smooth rollers 42 has a diameter slightly larger than the central roller 44. Suitable bearing means 46 and retaining means 48 securing the parts to the shaft complete this subassembly 26. The central roller 44 is made of a substantially rigid material having a random cavitation of its surface to provide a plurality of cavities which will provide receptacles for the ink material as well as providing edges to which the ink material can adhere by surface tension. In the partial cross-sectional view in FIG. 3, the roller 44 has a plurality of random cavities 50 which serve as pockets for carrying ink 52. As is well known in the chemical field, when a liquid having a high surface tension is disposed in relatively small droplets, the liquid tends to form a convex configuration that rises slightly above the nominal liquid level. This is generally indicated by the convex lines defining the upper surface of the ink 52 in each of the cavities shown in FIG. 3. A workpiece 60, as seen generally in FIG. 2, must have a width adequate to be in engagement with at least one of the rollers 42 so that it will be maintained either by tension or by a back-up roller (not shown) in contact with the roller 42 in spaced relation to the cavitated roller 44 so as to prevent smudging. Preferrably, the workpiece has a width adequate to extend between a pair of rollers 42 positioned on opposite ends of roller 44. In the illustrated embodiment the workpiece can be a multi-layered material, for example, the workpiece 60 can be a substrate carrying a plurality of secondary items 62, such as end to end labels, or another continuous web means with a width adapted to be disposed between the spaced rollers 42. If the secondary item 62 has a discrete thickness of considerable depth it might be necessary to increase the diameter of the spaced rollers 42 so that the workpiece 62 is maintained in spaced relation to the central cavitated roller 44.

The impregnated ink roller assembly 28 includes an impregnated roller 70 encased in a coaxial cover 72 having a segmental opening 74 through which the roller 70 projects. The roller and cover are mounted on a movable arm 76 rotatable about pivot 78 and urged by suitable spring means 80 into contact with cavitated roller 44. The two rollers 70 and 44 have substantially identical axial lengths so that ink is supplied to the entire surface of roller 44. The idler roller 34 rotates about the same pivot 78.

Figure 4:
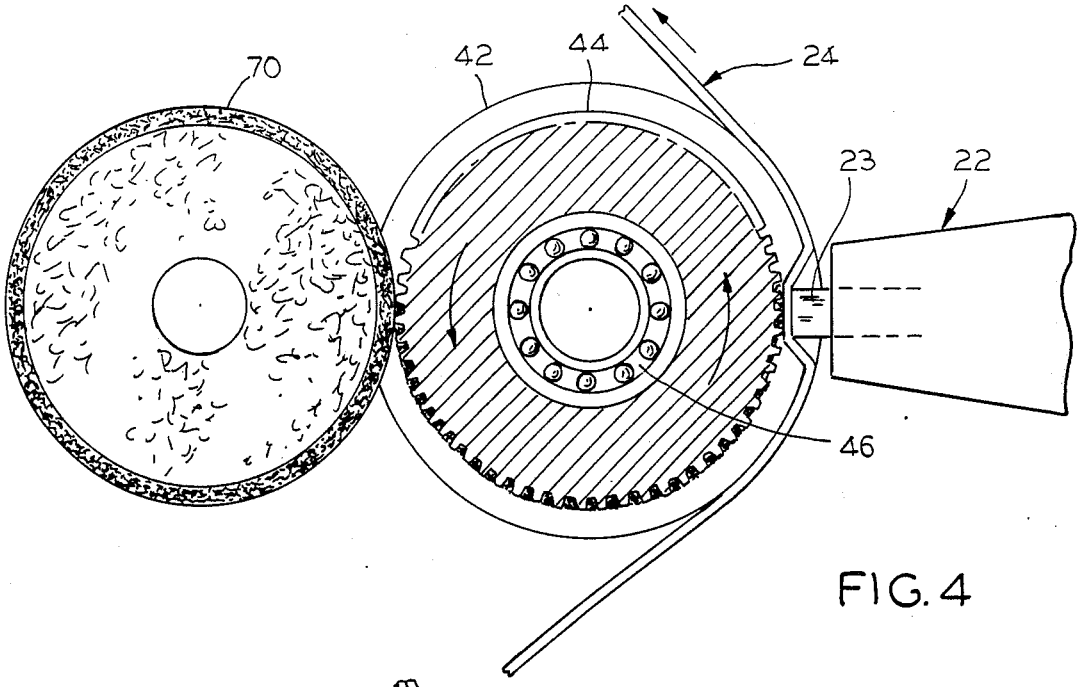
FIG. 4 is an enlarged schematic plan view in partial section showing the relationship between the impregnated ink roller and the ink transfer roller, as well as the exaggerated relationship of the workpiece with the smooth supporting rollers and the print wires which maintain the workpiece in spaced relation to the cavitated roller until impinged by the wires into contact with the ink.
Figure 5:
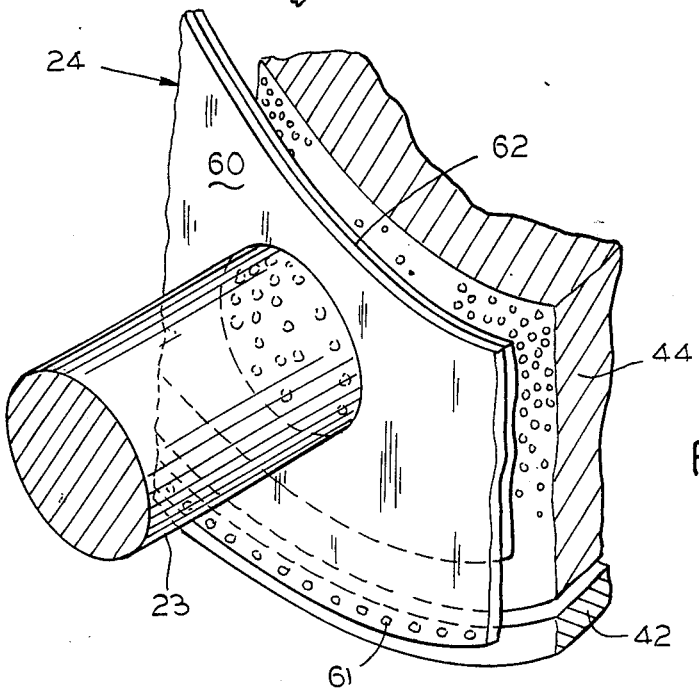
FIG. 5 is an enlarged fragmentary view in partial section of a portion of a transfer roller, a workpiece and a wire of the print head.

Referring now to FIG. 4, the spacing between the circumferential face of roller 42 and the surface of roller 44 is exaggerated to better display the relationship between the parts. Impregnated roller 70 extends radially inwardly of the face of rollers 42 and is disposed between the spaced rollers 42 so that it is in spring urged intimate contact with the cavitated roller 44 and remains so due to the urging of spring 80. (It should be noted that FIG. 4 is a bottom view, in partial section, of the view in FIG. 1 and with the cover 72 removed from roller 70). The workpiece or web is in intimate contact with roller 42 and depressed by pin 23 of printer head 22, the distance of the impingement being exaggerated for purposes of illustration. The fragmentary perspective view in partial section shown in FIG. 5 is another illustration of the workpiece 24 having its web or substrate 60 engaging the rim roller 42 in spaced relation to cavitated roller 44. The pin 23 of print head 22 is enlarged to indicate that a single pin or a multiplicity of adjoining heads can cover a plurality of adjoining cavities in the cavitated surface for purposes of causing the workpiece to come into the plane occupied by the convex surface 52 of the droplets 50 and thereby absorb or pickup by surface tension the ink by the surface of the workpiece. In this embodiment the web 60 includes a plurality of uniformly spaced holes 61 disposed along one or both edges (not shown) of the workpiece for engagement by a tractor drive 30 as is well known in the art.

It will be readily apparent to those skilled in the art that the computer signal to the printer will be of a mirror image category since the impulse is directed to the reverse side of the workpiece 24.

Figures 6, 7:
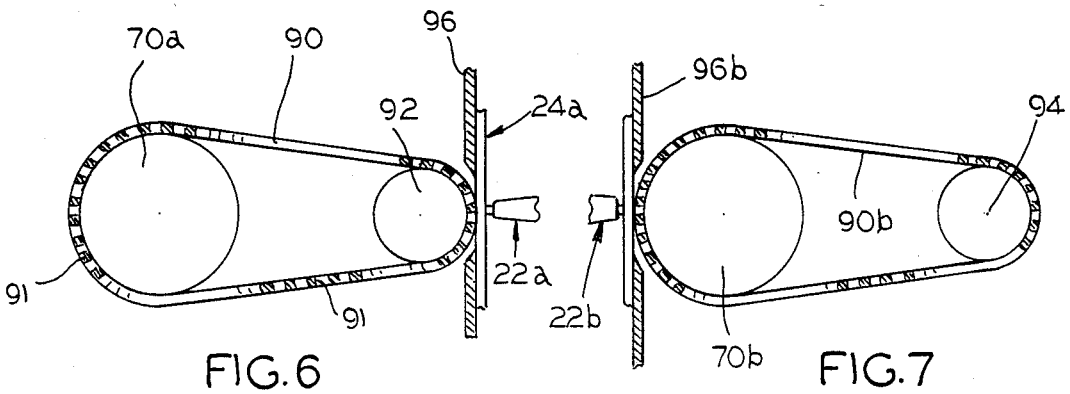
FIG. 6 is a plan schematic view of another embodiment of the present invention wherein an apertured belt is utilized as the means of carrying ink from a source to the workstation for engagement by the workpiece when impinged upon by the wire print head.
FIG. 7 is a further embodiment of the concept shown in FIG. 6 wherein the belt is in direct contact with the impregnated ink roller at the workstation.

Another embodiment of the present invention is disclosed in FIG. 6. In this embodiment a finely through-apertured continuous metal belt 90 encircles an impregnated ink roller 70*a* and a backup impression roller 92.

The ink is carried in the fine through apertures 91 from the roller 70*a* and presented to the front surface of the workpiece 24*a*. The mechanism is provided with suitable support means or rails 96 for maintaining the web 24*a* in spaced relation to the apertured belt means 90 until impinged upon by the print head 22*a*.

A further embodiment of the invention, as seen in FIG. 7, once again utilizes a finely through-apertured metal belt 90*b* that encircles an ink impregnated roller 70*b* and an idler roller 94 that maintains tension in the belt 90*b*. As will be noted, in this embodiment the ink supply in the form of impregnated roller 70*b* is located immediately at the point of impression where the print head 22*b* impinges on the workpiece 24*b* to bring it into engagement with belt 90*b*. In both of the embodiments of FIGS. 6 and 7 the power for driving the belt 90 and 90*b* can be supplied to either roller, however, it would be preferably applied to the smaller rollers 92 and 94.

Figure 8:
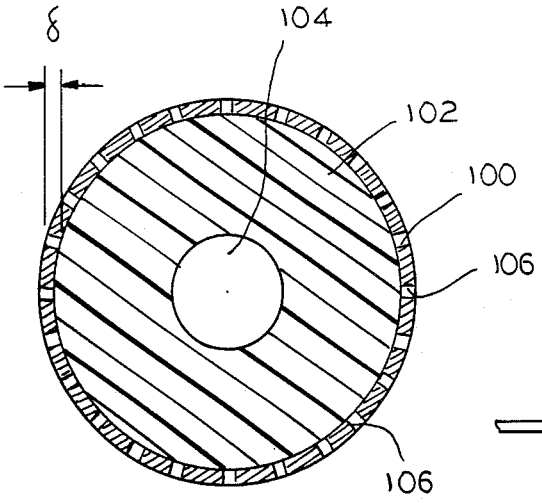
FIG. 8 is cross-sectional plan view of still another embodiment wherein a continuous belt encircles a cylindrical ink source, with the belt replacing the cavitated ink roller.

Referring now to FIG. 8, this embodiment utilizes the teachings of the apertured belt means shown above. In this instance the continuous belt 100 is mounted on an absorbent filler material 102 carried on a shaft 104. The belt is preferrably stainless steel screen material, (or any other non-rusting material to avoid a pitted surface), which obtains its through bores or apertures by photo etching or any other precise controllable hole making process such as electrode erosion. The plastic or other filler material chosen for the absorbent material 102 requires the ability to serve as an ink reservoir but also to provide adequate strength to back up the belt 100 and to maintain concentricity.

A roller of the type set forth above will provide measured amounts of ink in the caves or bore holes 106 by giving precise diameters and depths to the holes for storage of ink by capillary action from the roller 102.

Figure 9:
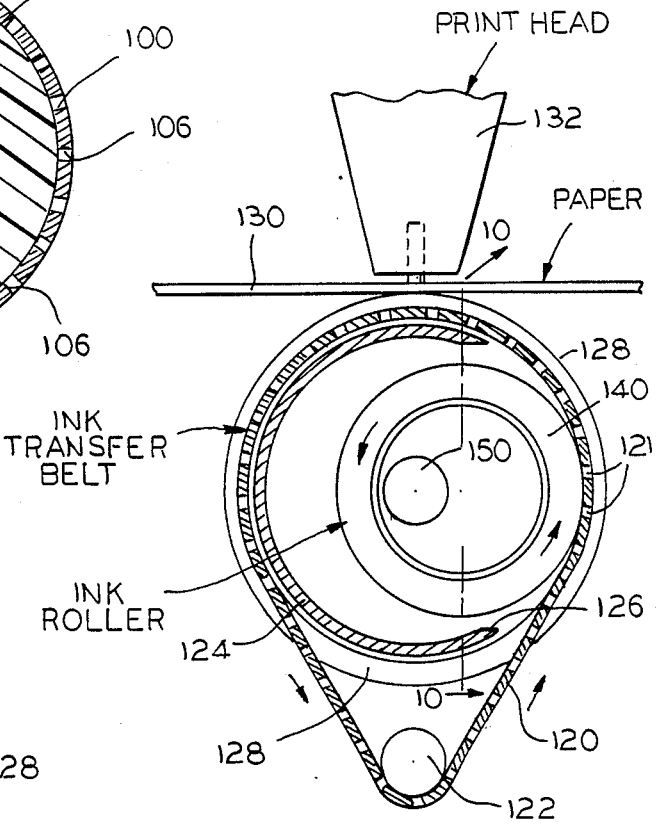
FIG. 9 is a cross-sectional schematic plan view of an additional embodiment wherein an apertured ink transfer belt means moves concentrically about an ink roller guide while an ink roller rotates eccentrically internally of said roller guide and is in direct contact with the interior surface of said belt means.
Figure 10:
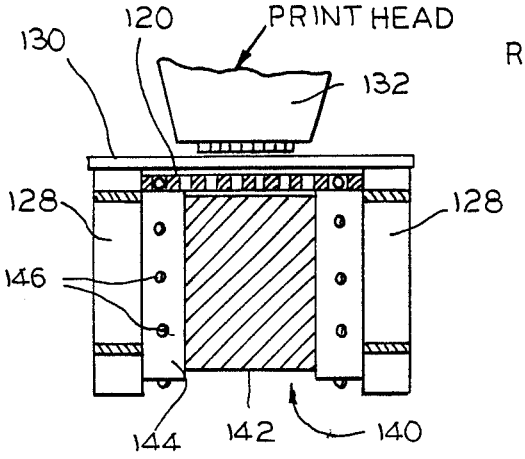
FIG. 10 is a partial cross-sectional elevational view device taken generally along line 10—10 of FIG. 9.
Figure 11:
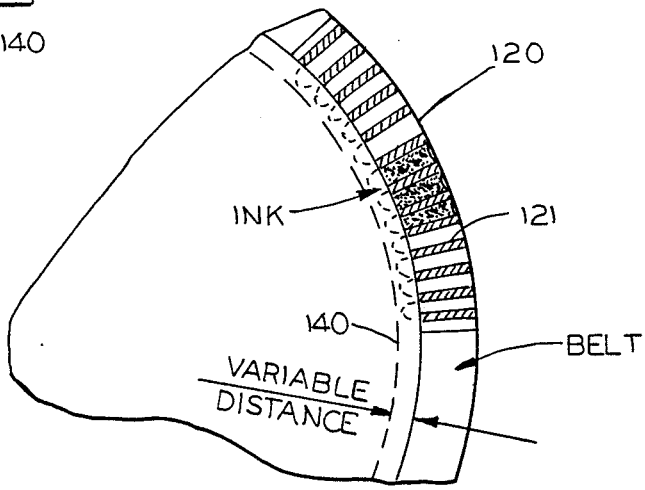
FIG. 11 is enlarged fragmentary cross-sectional view of an ink transfer belt and ink roller of the type generally shown in FIG. 9.

Another embodiment utilizing a perforated ink transfer belt can be seen in FIGS. 9 and 10 wherein an ink transfer belt 120 is driven by a power source 122 about an ink roller guide 124 having a side opening 126. Ink roller guide 124 is semi-circular and supported at opposite ends by concentric narrow cylinders 128 which are slightly larger than the diameter of belt 120 as it passes over the guide 124 to thereby serve as a support for the paper 130 spaced from the belt 120 at the point of impact by the print head 132. Positioned inside the ink roller guide 124 in an eccentric manner is the ink roller 140. Roller 140 includes a central hollow felt ink roller portion 142 supported at each end by a rigid band 144 having a plurality of circumferentially spaced protuberances 146, in the fashion of a tractor drive, that will mate with similarly spaced holes 121 in the edges of the belt 120. The roller 140 is hollow inside and supported by an idler wheel 150 positioned concentrically relative to the roller guide 124 and belt 120 but eccentrically relative to the ink roller 140, whereby the felt ink roller engages the interior of belt 120 and is driven by the protuberances 146 to turn with the belt 120 and transfer ink from the felt ink roller portion 142 by capillary action to the cavities formed by the through bores or apertures in belt 120. The ink stays in the channels of the bores 121 and does not get on the belt outer face until paper is compressed by the print head pins down onto the belt outer face and the paper then absorbs ink from the channels of the bores in the predetermined pattern of the pins to form an indicia means on the face of the paper.

The position of the eccentric ink filled roller can be changed manually or automatically to vary pressure between the impregnated felt portion of the ink roller and the transferring ink belt, where the ink travels from the inside to the outside of the belt 120. Due to the difference in diameters of the ink roller and the ink transferring belt the amount of ink is controllable dependent upon the pressure between those two structures. By varying the diameter of the ink roller the amount of contact between it and the belt can be narrowed down to virtually line contact, when minimum pressure is applied therebetween.

Thus, by supporting the paper 130 on the supporting end members 128 slightly away from belt 120; by supplying the ink from the interior of belt 120 by felt cylinder 142 the ink is kept off the exterior surface of the ink transfer belt 120 and thereby eliminates smearing on the paper and only transfers ink to those minute areas struck from the backside by the pins of print head 132 and depressed into contact with the belt 120 to absorb ink in the channel bores 121 to produce a printed indicia on the paper.

Thus, a unique system of printing has been disclosed wherein the workpiece is impinged upon from the rear side thereof and brought into initmate engagement with the miniscus of the droplet to cause absorption of the ink or alternatively to cause the withdrawal of the droplet from its cave by a greater surface tension relative to the workpiece to thereby break the hold on the edges of the perforated belt means. The ink material is quickly replaced by the impregnated rollers on the next revolution without any splashing or messy spills.

The relative sizes of the rollers is merely exemplary and substantial enlargements in the roller sizes can be made, as well as the provision of either multiple or moving print heads that will traverse the length of the roller at high speeds. An application for such a printing system can be found in a companion application filed concurrently herewith, Ser. No. 109,216, filed Oct. 16, 1987, that relates to the printing of pressure sensitive adhesive labels disposed in end-to-end relation on a substrate for correction of forwarding addresses on mail.

Similarly, the use of a continuous web, either with or without tractor drive holes, can be eliminated in favor of single sheet feed means as are known in the art. However, it will be recognized that the web feed will result in faster, more efficient and economical use of this system.

I claim:

1. A printing system including a cavitated ink transfer means carrying a predetermined amount of ink in its cavities for use in an electronically controlled printer that includes a dot matrix printing head having impression pin means, at least one workpiece carried by a support medium in spaced relation to said cavitated ink transfer means, said at least one workpiece adapted to be pushed sequentially by said pin means from its backside through said support medium to cause its front surface to pick up predetermined amounts of said ink from said cavitated ink transfer means in predetermined symbol array, said ink transfer means being a roller wherein said cavities are indiscriminately placed in close tight relation providing cavities for retention of ink material by surface tension as series of ink droplets positioned in close proximity, whereby movement of said impression pins of said matrix printing head moves selected areas of said at least one workpiece into contact with certain of said droplets to form indicia means on the surface of said workpiece, said ink transfer roller further including an assembly having a central generally cylindrical portion, said plurality of cavities being impressed in the surface of said central portion, at least one guide roller positioned adjacent at least one end of said cylindrical portion, said guide roller having a diameter slightly larger than said central portion, the difference in the radial extent between said roller and said central portion being at least as great as the thickness of said at least one workpiece, said support medium riding on said guide roller and supporting a plurality of said at least one workpiece individually and sequentially in position over said central portion, said impression pins locally depressing said support medium and one of said at least one workpiece into contact with the ink carried by said central portion, and thereby sequentially creating a predetermined symbolic array on each of said at least one workpiece.

2. An ink transfer roller unit of the type claimed in claim 4 wherein said central portion is of a substantially rigid material which is impinged upon to form said cavities.

3. An ink transfer roller unit of the type claimed in claim 2 wherein said central portion is metallic in nature and said cavities are is formed by sand blasting.

4. An ink transfer roller unit including a plurality of coaxially disposed portions adapted to be rotated about a common axis, said ink transfer unit including a central cavitated portion of generally cylindrical configuration, the surface of said central portion having a plurality of indiscriminately arranged cavities for retaining ink droplets of a predetermined size therein by surface tension, a pair of guide roller portions disposed adjacent to the said cavitated central portion, said unit further including a shaft mounting said cavitated central portion thereon, one roller portion of said pair of roller portions being positioned at each end of said central portion, each of said guide roller portions being of a predetermined larger radial extent than said central portion, each of said guide roller portions being non-cavitated in nature, elevated above said central portion, and substantially incapable of carrying ink, and said unit further including bearing means supporting said guide roller means on said shaft for independent rotation relative to said central portion.

5. An ink transfer roller unit of the type claimed in claim 4 wherein said central portion is metallic in nature and said cavities are of such a size as to be able to be formed by sand blasting.

6. An ink transfer roller unit of the type claimed in claim 5 wherein said central portion is adapted to cooperate with pin matrix means and to accept material to be printed upon in a position adjacent thereto to be impinged upon and thereby transfer said ink material to the surface of the accepted material, the difference in said predetermined radial extent between said central portion and said guide rollers being at least equal to the thickness of said material to be printed upon.

7. An ink transfer roller unit of the type claimed in claim 5 wherein said cavities have a predetermined depth and width forming a size of cavity controlled and matched to a predetermined size of printing to be accomplished by a particular roller, and thereby to provide sufficient ink to form the desired size of printed dot.

8. An assembly of the type claimed in claim 1 wherein said support medium is a continuous elongated tape-like means carrying a plurality of said at least one workpiece in sequential end to end relation on said support medium.

* * * * *